US005790388A

United States Patent [19]

Buckingham

[11] Patent Number: 5,790,388

[45] Date of Patent: Aug. 4, 1998

[54] ANTISEISMIC STATIC ELECTRICAL CONVERTER APPARATUS

[75] Inventor: Andrew Douglas John Buckingham, Staffordshire, United Kingdom

[73] Assignee: GEC Alsthom Limited, United Kingdom

[21] Appl. No.: 566,974

[22] Filed: Dec. 4, 1995

[51] Int. Cl.[6] ..... H02M 7/00

[52] U.S. Cl. ..... 363/13; 363/68; 363/123; 174/42

[58] Field of Search ..... 363/13, 35, 68, 363/123, 141, 144; 174/42, 43, 150

[56] References Cited

U.S. PATENT DOCUMENTS

| | | | |
|---|---|---|---|
| 3,654,543 | 4/1972 | Isogai et al. | 321/27 R |
| 4,090,233 | 5/1978 | Thiele et al. | 363/68 |
| 4,318,169 | 3/1982 | Olsson | 363/123 |
| 4,494,173 | 1/1985 | Ikekame et al. | 363/68 |
| 4,583,158 | 4/1986 | Ikekame et al. | 363/68 |
| 4,631,656 | 12/1986 | Olsson | 262/123 |
| 5,117,346 | 5/1992 | Gard | 363/51 |
| 5,249,114 | 9/1993 | Asplund et al. | 363/68 |

*Primary Examiner*—Peter S. Wong
*Assistant Examiner*—Derek J. Jardieu
*Attorney, Agent, or Firm*—Kirschstein, et al.

[57] ABSTRACT

An antiseismic static electrical converter installation comprises a valve assembly mounted on a platform, the platform being suspended at each of two opposite ends from a series of rods which are attached in a spaced-out relationship to a horizontal beam, the beam being mounted on the ground via rubber springs. During an earthquakes movement of the ground causes mainly lateral distortion of the rubber springs and elastic bending of the rods, and, since the natural resonant frequency of the suspension system is designed to be low and the rubber springs are deigned to have significant damping, a high degree of isolation is provided for the platform and the equipment mounted on it. During severe earthquakes, the rods are arranged to suffer a plastic bending which causes them to act like pendulums and changes the natural frequency of the suspension system to increase the damping and provide greater protection. Ideally, the tops of the rods are arranged to be level with the combined center of mass of the valve assembly and the platform so that the valve assembly is prevented from experiencing a bending moment about the combined center of mass.

19 Claims, 5 Drawing Sheets

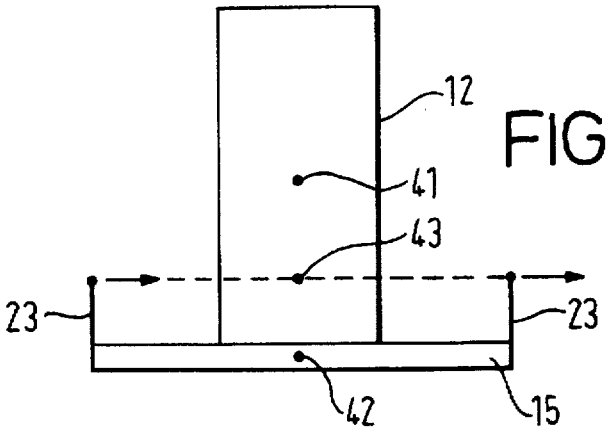
FIG. 5
FIG. 6
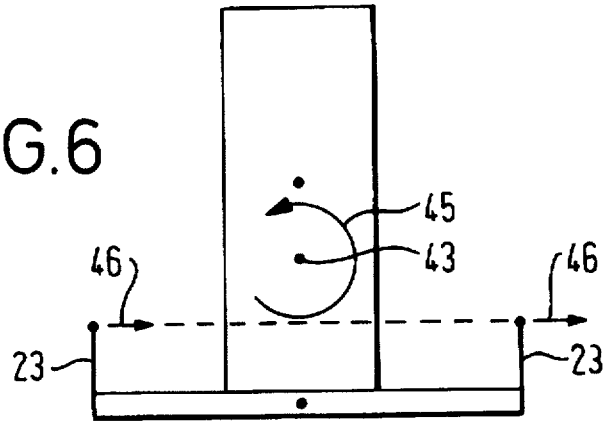
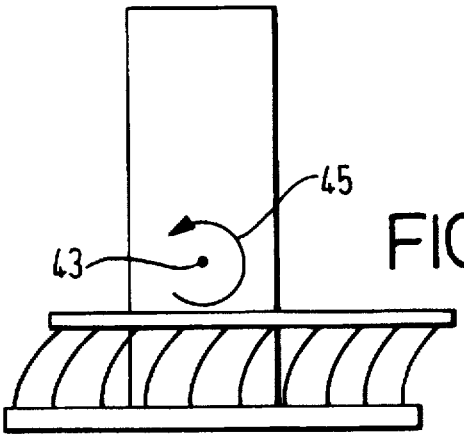
FIG. 7

ANTISEISMIC STATIC ELECTRICAL CONVERTER APPARATUS

BACKGROUND OF THE INVENTION

The invention relates to a static electrical converter arrangement for use in an area of high seismic activity, and in particular, but not exclusively, a thyristor-valve static electrical converter arrangement for a high-voltage DC link.

Static electrical converter arrangements are known in which a converter, e.g. a thyristor valve assembly, is mounted on the ground. The valve assembly consists of an electrically insulating structure containing a number of series-connected semiconductor devices arranged in tiers to form a tall stack. This type of valve arrangement works well under normal operating circumstances, but it has the disadvantage in earthquake conditions that the valve assembly is exposed to considerable displacement in its various parts due to movement of the ground, and the assembly can suffer failure due to such movement.

One possible system which attempts to overcome this problem is the isolated base-mounted system, as used in civil engineering structures, in which the assembly is mounted on some form of resilient base, so that it is decoupled to at least some degree from the ground. Such isolation of the assembly from the ground is, however, limited in its effect.

Another system used to increase isolation is the ceiling-suspended system. In this arrangement, the valve assembly is hung from suspension points on the ceiling or roof of the valve hall in which the assembly is housed. The suspension points comprise supporting rods made of an insulating material, the rods being attached to the ceiling by means of some form of resilient mounting, e.g. springs. While such an arrangement does afford superior isolation, it suffers the disadvantages that the valve assembly is excited in the first place by higher-amplitude displacements due to movement of the building, and it can be prone to catastrophic failure; this is because of the suspension arrangement whereby the various supporting components of the assembly are in tension rather in compression, as is the case with the base-mounted system.

It would be desirable to provide a static electrical converter arrangement which seeks to overcome or mitigate the drawbacks associated with the known arrangements.

SUMMARY OF THE INVENTION

In accordance with a first aspect of the invention, there is provided a static electrical converter installation including a column of series-connected valve modules and a suspension arrangement, the suspension arrangement including a platform, upon which the valve column is mounted, and a plurality of rods, said platform being suspended by means of said rods, said rods being fixedly attached to the platform and extending up to the level of an intermediate point in the height of the column and being supported by ground-referenced support means at that level, said intermediate point being selected such that rotation of said column about all axes following seismic disturbance of said support means is reduced, and the rods having stiffness such as to limit seismic movement of said column.

Said level of an intermediate point may be a combined center of mass of the valve column and the platform.

In accordance with a second aspect of the invention, there is provided a static electrical converter installation including a column of series-connected valve modules and a suspension arrangement, the suspension arrangement including a platform, upon which the valve column is mounted, and a plurality of rods, said platform being suspended by means of said rods, said rods being fixedly attached to the platform and extending up to the level of an intermediate point in the height of the column and being supported by ground-referenced support means at that level, the suspension arrangement being arranged to operate in a first mode of low-frequency oscillation at low levels of seismic activity, in which first mode the rods deflect in an elastic fashion, or in a second mode of low-frequency oscillation at higher levels of seismic activity, in which second mode the rods deflect in a plastic fashion, said second mode having the effect of changing the natural frequency of the suspension arrangement, thereby increasing the damping thereof. Said intermediate point may be selected such that rotation of said column about all axes following seismic disturbance of said support means is reduced.

In accordance with a third aspect of the invention, there is provided a static electrical converter installation including a column of series-connected valve modules and a suspension arrangement, the suspension arrangement including a platform, upon which the valve column is mounted, and, for each of two opposite ends of the platform, a substantially horizontal beam member and a plurality of rods, the beam member being resiliently mounted to the ground by way of a mounting means and the rods being disposed spaced apart from each other and suspended at one end from the respective beam member and attached at the other end to the respective end of the platform, the platform being suspended clear of the ground by the rods.

The converter arrangement is essentially a base-mounted system, but enjoying the advantages of greater isolation from ground tremors afforded by a roof-suspension system. Other advantages accrue from the use of this arrangement. Firstly, because the arrangement is base-mounted and the suspension is referenced to ground rather than the roof of a valve hall, as is the case with conventional suspension systems, the valve assembly and associated components are exposed to less movement in an earthquake than is the case with the suspended-valve arrangements. This is because any ground movements are amplified in a suspended system by the building to which the valve assembly is attached. Thus, valve excitation is dependent on building response, whereas in the base-mounted systems, including the invention, valve excitation is not dependent on such response. Analysis has shown that displacement in the case of the invention is likely to be less than 25% of the displacement that would be experienced by a suspended valve. This greatly assists the design of busbar connections within the valve hall and reduces potential wall-bushing forces. Secondly, the converter arrangement according to the invention is inherently less susceptible to the effects of fire. One reason for this is that all the valve column support legs are in compression under dead weight loads acting on the platform, whereas in the case of a conventional suspended arrangement, the support legs are in tension, so that melting of such support members can lead to the entire valve assembly crashing down several meters to the ground. Another reason is that the suspension system is far away from the combustible elements within the valve that might cause a fire, whereas in a normal suspended arrangement, a fire would engulf valves and supporting structures alike.

The mounting means may comprise, for each end of the beam member, a rigid post secured to the ground and a resilient mount disposed between the rigid post and the respective end of the beam member. Use of a rigid post anchored to the ground allows the length of the rods to be varied, which in turn affects the dynamic performance of the suspension system in a manner to be described later.

The resilient mount may comprise a rubber spring or a steel helical spring, or any other type of spring. It is convenient to use a rubber spring, since this has its own inherent damping, but where another form of spring is used, it may be necessary to employ in conjunction with the spring a separate damping element such as a hydraulic hysteresis or friction damping device.

The rigid post may comprise a stop means secured to an upper surface of the post, the stop means serving to limit the lateral excursion of the associated resilient mount. By incorporating such a stop means, the converter arrangement according to the invention is allowed to move from a low-displacement mode of operation to a high-displacement operation in which behavior of the rods is modified to lower the natural frequency of the suspension system and provide greater protection against severe earthquakes.

The rods may be composed of a ductile material, e.g. mild steel, and the rubber mounts may be high-damping rubber mounts. Use of a ductile material for the rods, e.g. mild steel, enhances the energy-absorbing characteristics of the rods and enables them to be elastically or plastically deformed in an earthquake.

The suspension arrangement may be arranged so that a line joining the two beam members substantially passes through the combined center of mass of the valve assembly and the platform, This measure has the advantage of precluding any bending moment forces that might act upon the valve assembly and its associated components as a result of ground movement.

The platform may be a structure having high bending stiffness and may be a box-like structure containing ballast in order to increase its mass. The platform may be composed of steel and the ballast of cast iron or other high-density material. The rigid post may be composed of steel or concrete.

The rods may be swivellably supported from the beam member. A convenient way of achieving this is by supporting each of the rods from a cup washer which is itself supported by the beam member. The rods pass through the cup washers and are secured behind them. The advantage of using a swivel mounting for the rods is that the upper part of the rods is not unduly strained when earth movements, particularly high-level movements, occur.

BRIEF DESCRIPTION OF THE DRAWINGS

The invention will now be described, by way of example only, with reference to the drawings, of which:

FIGS. 5, 6 and 7 are simplified side views of the static electrical converter arrangement according to the invention illustrating the effect of a bending couple;

DETAILED DESCRIPTION OF THE EMBODIMENT OF THE INVENTION

Figure 1:
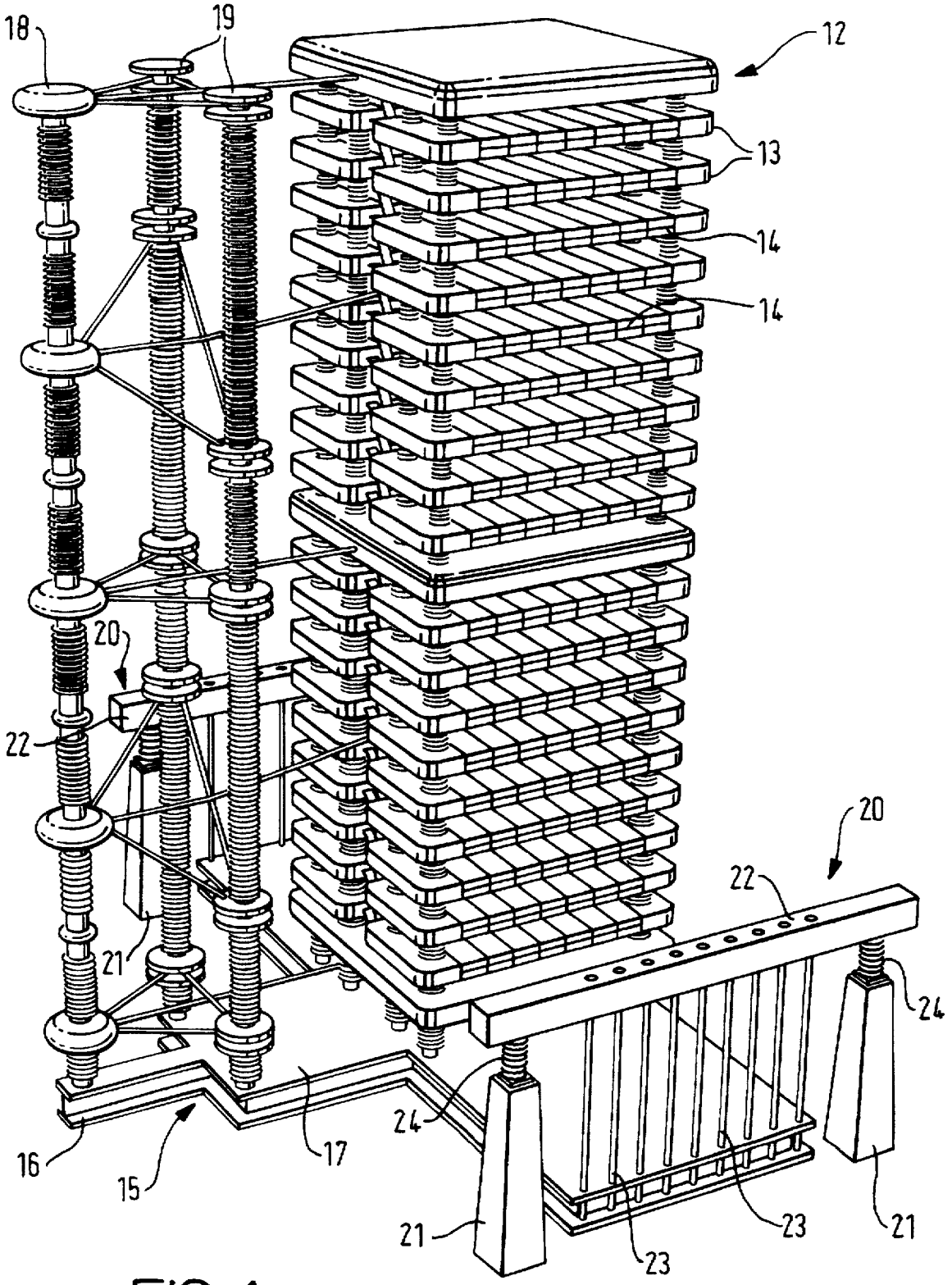
FIG. 1 is a pictorial view of a static electrical converter arrangement according to the invention.

Referring now to FIG. 1, in FIG. 1 a thyristor valve assembly 12, consisting of a number of tiers 13 of series-connected thyristor levels 14, is shown resting on a platform 15. The platform 15 consists of a prefabricated, low-profile steel box made up of "T"-section members 16, the box being filled with cast iron to increase the mass of the platform structure. A cover plate 17 is placed over the box to provide a firm foundation for the valve assembly 12. The total mass of the platform structure is between 40 and 80 tonnes.

Situated alongside the valve assembly 12 and connected to it at various points are a valve capacitor stack 18 and a pair of surge-arrestor stack 19. These are well-known adjuncts to the functioning of a high-voltage static converter and will therefore not be described in detail here. It is to be noted, however, that the stacks 18 and 19 are mounted on the same platform 15 as the valve assembly 12.

At opposite ends of the platform 15 are a pair of suspension means 20, which are identical for each end and constitute a suspension arrangement of the installation. The suspension means 20 consists of a pair of rigid concrete or steel posts 21 anchored securely to the ground, a horizontal beam member 22, which is of a box construction, 5 and a number of vertically disposed rods 23. The rods 23, which are composed of a ductile mild steel, are attached at one end to the beam member 22 and at the other end to the platform 15. The beam member is supported on the two posts 21 by way of a pair of rubber springs 24.

The platform is arranged to be suspended about 100 mm above the ground by the rods acting through the beam member and the rubber springs to ground via the rigid posts 21. The platform may either be set into the floor so that its top surface is at floor level, or it may be mounted above floor level, depending on considerations of access or electrical clearance.

The functioning of the static converter arrangement according to the invention will now be described in detail.

Figure 2:
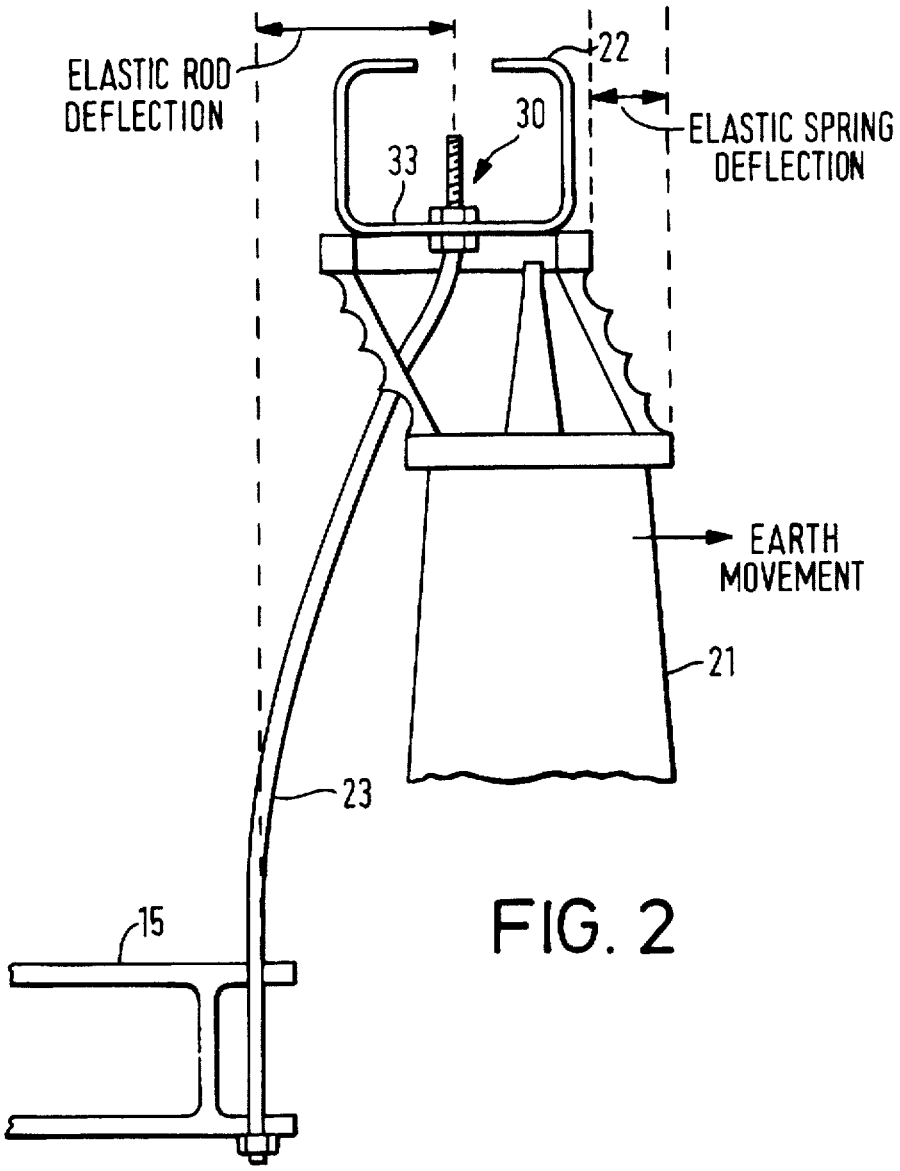
FIG. 2 is an end-on view of the suspension arrangement of the static electrical converter arrangement according to the invention illustrating the effect of a light earthquake.

When an earthquake occurs, the ground moves relative to the platform and the various equipment mounted on it. The effect of a low-level quake is shown in FIG. 2, which includes an end-on view along the beam 22 of the suspension means 20. In FIG. 2, it is assumed there is an earth movement of, say, 170 mm laterally, which is shown as a corresponding movement to the right of the post 21 relative to the platform 15. This movement causes the rubber spring 24 to flex, also laterally, as shown and the rods 23 (only one of which is shown) to bend in their upper portion. Thus, the total rubber spring deflection is, say, 70 mm and the deflection of the rods 100 mm in the directions shown. This deflection of the rods 23 is an elastic deflection and is one from which the rods can recover without their suffering any permanent harm.

Figure 3:
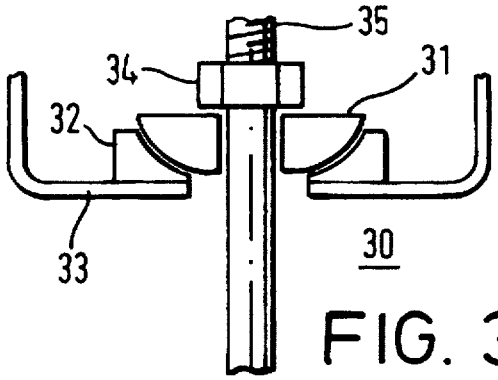
FIG. 3 is a diagram of a mounting arrangement used in the suspension arrangement of FIG. 2.

In the preferred embodiment, the rods 23 are secured at their upper ends to the beam member 22 by a cup washer arrangement 30 such as shown in FIG. 3. This arrangement comprises a cup washer 31 mounted on a mounting piece 32, which in turn rests on the floor 33 of the box member 22. Each of the rods is fed through its own cup washer 31 and secured in place by a nut 34 on a threaded portion 35 of the rod. Now, when the ground moves, the cup washer 31 swivels in its mounting piece 32, thereby relieving the upper part of the rods 23 of unwanted strain.

The natural frequency and the damping of the suspension arrangement illustrated is such as to ensure that the platform 15 is only minimally accelerated by such a seismic shock. In a preferred embodiment of the invention, the rubber springs 24 are arranged to provide approximately 10% damping.

Figure 4:
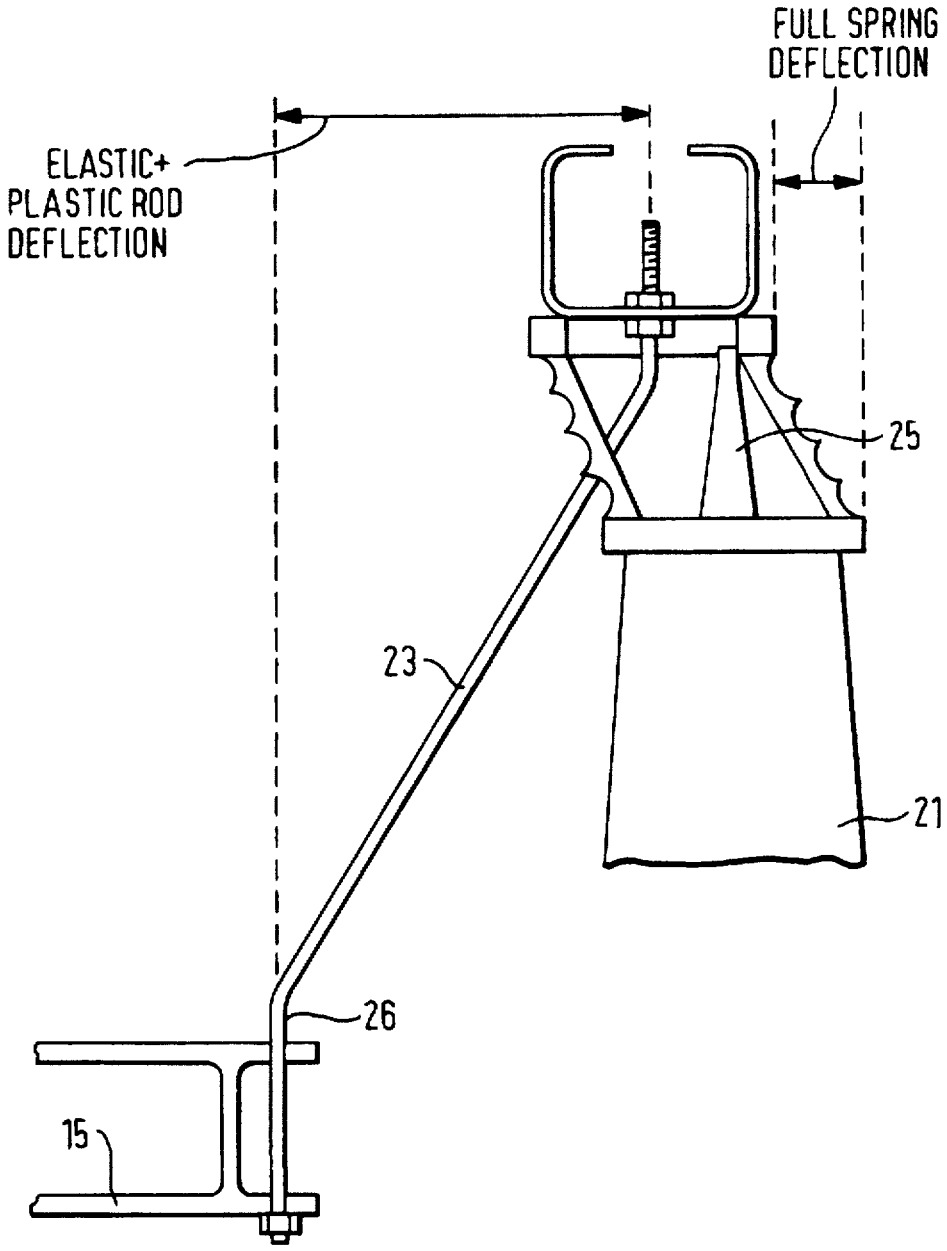
FIG. 4 is an end-on view of FIG. 2, but illustrating the effect of a heavy earthquake.

The behavior of the suspension system at higher earthquake levels will now be considered with reference to FIG. 4.

FIG. 4 depicts the same suspension elements as FIGS. 2 and 3, but this time 10 it is assumed that a significantly larger earth movement has taken place. Under these circumstances, it is arranged for the lateral excursion of the rubber springs to be limited by the provision of a stop 25 attached to the upper face of the post 21. The stop 25 limits the spring displacement to approximately 100 mm (corresponding to roughly 40% of the diameter of the spring). This in turn means that the rods 23 are displaced even further from their normal vertical position, in this case, say, 400 mm. Now, however, in view of the magnitude of the displacement, the rods 23 are made to bend in a hingelike fashion at their base at the attachment point 26 of the rods to the platform 15. The rods now behave as pendulums swinging from the attachment points 26 and the result is a lowering of the natural frequency of the suspension system. In this mode, the rods exhibit hysteresis damping. The length, diameter and mass of the rods are chosen to give a natural suspension frequency of less than 0.2 Hz. It has been shown that a high-level earthquake possesses most of its energy at frequencies substantially higher than this, so that the platform and the equipment mounted thereon is not set into resonance by such a ground movement.

This type of displacement of the rods is plastic, as opposed to the elastic displacement suffered during a lesser seismic shock. A plastic displacement does have a deleterious effect on the life of the rods, and it is anticipated that, in the event of a severe quake, the rods will be replaced as a safety measure. This is clearly best done one by one to avoid any danger of the platform becoming lowered with all the attendant weight of the valve assembly and capacitor stacks, etc, on top of it.

It should be noted that, although FIGS. 2 and 4 show the rods 23 being displaced in a plane perpendicular to the longitudinal axis of the beams 22, they may also be displaced in any other plane, erg. in the plane parallel to the longitudinal axis of the beams.

Although most of the energy of an earthquake is dissipated in the form of lateral movement of the ground, there is also some vertical movement. The rubber springs 24 are arranged to have a low-enough spring rate and sufficient damping to provide not only lateral isolation of the platform structure, but also a measure of vertical isolation. In view of the anticipated limited vertical excursions of the platform, the platform is arranged to be suspended only approximately 100 mm above the ground. This has the desired spin-off that, in the event of a failure of the suspension system, e.g. by a fire damaging The rubber springs, the platform has only a very small distance to travel to the ground. This is in contrast to a roof-suspended valve arrangement, where the valve assembly hangs several meters above the ground, mainly for insulation reasons.

In a preferred embodiment of the invention, the beams 22 are arranged to be level with the combined center of mass of the equipment standing of the platform, in particular the valve assembly. This feature is shown in FIG. 5, where the valve assembly 12 is assumed to be approximately 40 tonnes in weight and the platform structure 15 60 tonnes. The center of mass of the valve assembly is shown at 41 and that of the platform at 42. The combined center of mass is situated at 43 and the tops of the rods 23 (i.e. corresponding to the longitudinal axis of the beams 22) are arranged to be at the same height as the combined center of mass 43. The effect of this is that, since the ground reference 44 may be seen as being located at the tops of the rods 23, any movement of the ground passes through the combined center of mass and exerts no rotational couple on the valve assembly.

When the rod length is not so matched to the combined center of mass, however, a couple does exist. This is illustrated in FIG. 6, in which the tops of the rods 23 are shown to be lower than the combined center of mass 43. A couple 45 then results which tends to turn the valve structure about the center of mass in the direction shown for an initial earth movement as shown by the arrows 46.

Exactly the same applies in the plane orthogonal to that shown in FIGS. 5 and 6. Thus, in FIG. 7, the tops of the rods 23 are again lower than the combined center of mass 43, so that when the rods 23 are bent in the direction shown by a quake, a turning couple 45 (again anticlockwise) is produced which causes the valve assembly to be turned about that center of mass in that plane.

However, even where exact alignment of the tops of the rods with the combined center of mass is not achieved, the suspension arrangement effectively provides a high rotational stiffness, thereby limiting rolling and pitching of the suspended assembly to an acceptable amount.

Figure 8:
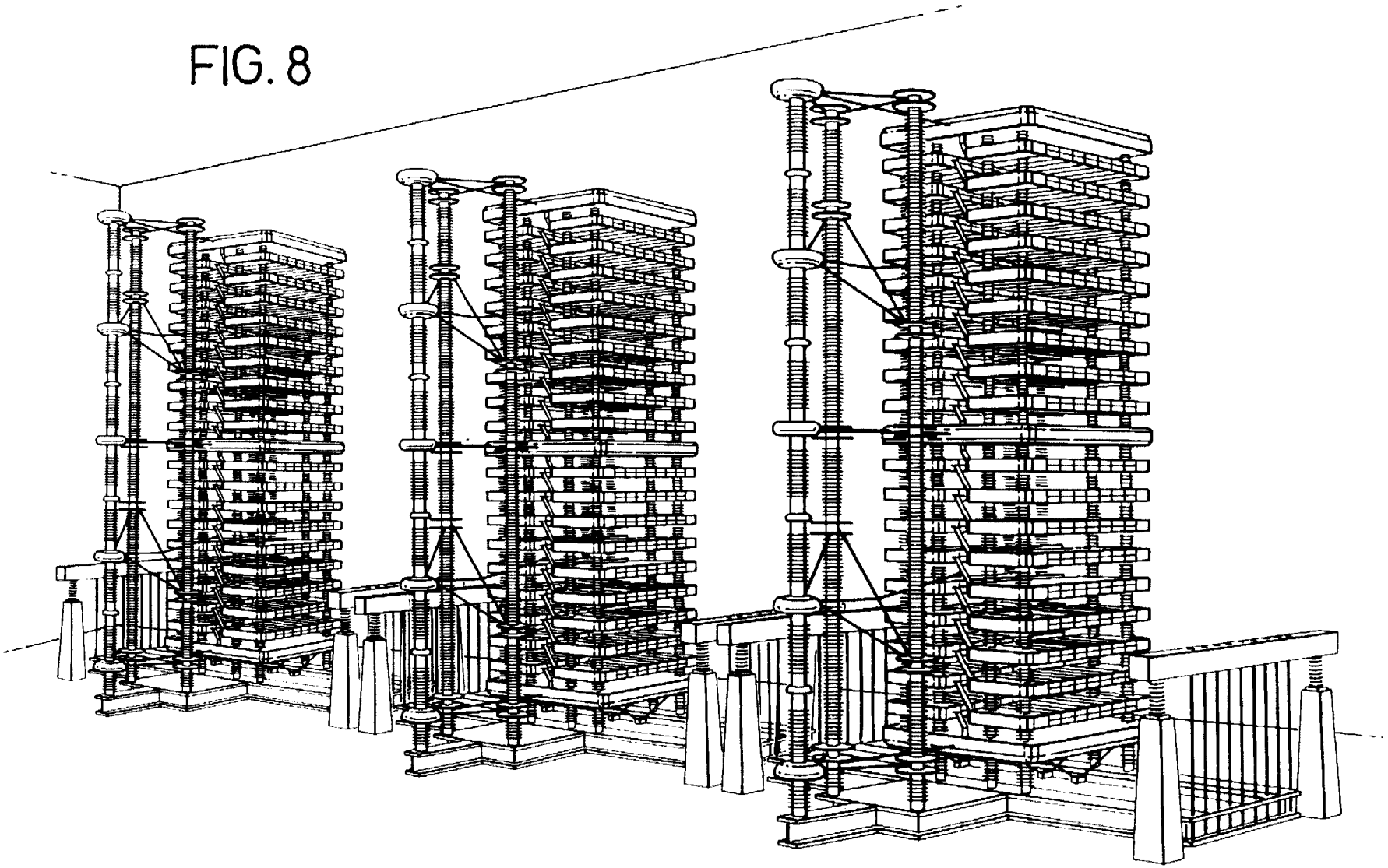
FIG. 8 is a pictorial view of a complete thyristor valve installation incorporating three static electrical converter arrangements according to the invention.

Clearly, where the rods 23 are required to be a certain length in order to take advantage of the above bending-moment cancelling effect, this will determine to some measure the other variables which affect the natural frequency of the suspension system, e.g. the mass or thickness of the rods, in order to arrive at a required natural frequency.

Where several thyristor valve arrangements are required in an installation, e.g. for a 3-phase conversion system, an appropriate number of complete static electrical converter arrangements may be placed next to each other in any convenient configuration. A suitable configuration in the case of the arrangement of FIG. 1 is shown in FIG. 8. Thus each assembly is equipped with its own suspension system as described above, so that each assembly is isolated individually from ground movement.

Typical dimensions and magnitudes of various elements in a preferred embodiment of the static electrical converter arrangement according to the invention are:

Valve assembly weight: 40 tonnes

Valve assembly height: 12 m

Platform weight: 60 tonnes

Platform clearance to ground: 100 mm

No. of rods: 18

Diameter of rods: 50 mm.

I Claim:

1. Static electrical converter installation including a column of series-connected valve modules and a suspension arrangement, the suspension arrangement including a platform, upon which the valve column is mounted, and a plurality of rods, said platform being suspended by means of said rods, said rods being fixedly attached to the platform and extending up to the level of an intermediate point in the height of the column and being supported by ground-referenced support means at that level, said intermediate point being selected such that rotation of said column about all axes following seismic disturbance of said support means is reduced, and the rods having stiffness such as to limit seismic movement of said column.

2. Static electrical converter installation as claimed in claim 1, in which said level of an intermediate point is the combined center of mass of the valve column and the platform.

3. Static electrical converter installation including a column of series-connected valve modules and a suspension arrangement, the suspension arrangement including a platform, upon which the valve column is mounted, and a plurality of rods, said platform being suspended by means of said rods, said rods being fixedly attached to the platform and extending up to the level of an intermediate point in the height of the column and being supported by ground-referenced support means at that level, the suspension arrangement being arranged to operate in a first mode of low-frequency oscillation at low levels of seismic activity, in which first mode the rods deflect in an elastic fashion, or in a second mode of low-frequency oscillation at higher levels of seismic activity, in which second mode the rods deflect in a plastic fashion, said second mode having the effect of changing the natural frequency of the suspension arrangement, thereby increasing the damping thereof.

4. Static electrical converter installation as claimed in claim 3, in which said intermediate point is selected such that rotation of said column about all axes following seismic disturbance of said support means is reduced.

5. Static electrical converter installation including a column of series-connected valve modules and a suspension arrangement, the suspension arrangement including a platform, upon which the valve column is mounted, and, for each of two opposite ends of the platform, a substantially horizontal beam member and a plurality of rods, the beam member being resiliently mounted to the ground by way of a mounting means and the rods being disposed spaced apart from each other and suspended at one end from the respective beam member and attached at the other end to the respective end of the platform, the platform being suspended clear of the ground by the rods.

6. Static electrical converter installation as claimed in claim 5, in which the suspension arrangement is arranged so that a line joining the two beam members substantially passes through the combined center of mass of the valve column and the platform.

7. Static electrical converter installation as claimed in claim 5, in which the rods are composed of a ductile material.

8. Static electrical converter installation as claimed in claim 7, in which the rods are composed of mild steel.

9. Static electrical converter installation as claimed in claim 5, in which the platform is a structure having high bending stiffness.

10. Static electrical converter installation as claimed in claim 9, in which the platform is a box-like structure and contains ballast to increase the mass.

11. Static electrical converter installation as claimed in claim 10, in which the platform is composed of steel and the ballast is composed of cast iron.

12. Static electrical converter installation as claimed in claim 5, in which the rods are suspended from the beam member by respective swivel means.

13. Static electrical converter installation as claimed in claim 12, in which the swivel means are cup washers supported by the beam member, the respective rods being passed through, and secured behind, said cup washers.

14. Static electrical converter installation as claimed in claim 5, in which the mounting means comprises, for each end of the beam member, a rigid post secured to the ground and a resilient mount disposed between the rigid post and the respective end of the beam member.

15. Static electrical converter installation as claimed in claim 14, in which the resilient mount includes a rubber spring.

16. Static electrical converter installation as claimed in claim 14, in which the rigid post includes a stop means secured to an upper surface of the post, the stop means serving to limit a lateral excursion of the associated resilient mount.

17. Static electrical converter installation as claimed in claim 14, in which the rigid post is composed of steel or concrete.

18. Static electrical converter installation as claimed in claim 14, in which the resilient mount includes a steel helical spring with a separate damping element.

19. Static electrical converter installation as claimed in claim 18, in which the damping element is a hydraulic hysteresis or friction damping device.

* * * * *